US005853121A

United States Patent [19]

Francisco

[11] Patent Number: 5,853,121

[45] Date of Patent: Dec. 29, 1998

[54] INSULATED CHEST

[75] Inventor: Lelia H. Francisco, Stockbridge, Ga.

[73] Assignee: Laminating Technologies, Inc., Atlanta, Ga.

[21] Appl. No.: 906,709

[22] Filed: Aug. 5, 1997

[51] Int. Cl.[6] ..... B65D 5/24

[52] U.S. Cl. ..... 229/188; 229/115; 229/117.14; 229/155

[58] Field of Search ..... 229/188, 186, 229/115, 116.4, 117.14, 155, 229; 493/136, 137, 138, 139, 390, 391

[56] References Cited

U.S. PATENT DOCUMENTS

| | | | |
|---|---|---|---|
| Re. 32,270 | 10/1986 | Murray, Jr. | 428/335 |
| 3,028,952 | 4/1962 | Milio et al. | 229/155 X |
| 3,067,924 | 12/1962 | Baker et al. | 229/188 X |
| 3,235,395 | 2/1966 | Scharf | 117/3.3 |
| 3,246,829 | 4/1966 | Sexton | 229/188 X |
| 3,434,901 | 3/1969 | Griffiths et al. | 156/210 |
| 3,630,826 | 12/1971 | Rose et al. | 161/190 |
| 3,748,204 | 7/1973 | Murayama et al. | 156/244 |
| 3,862,869 | 1/1975 | Peterson et al. | 156/244 |
| 3,904,104 | 9/1975 | Kane | 229/3.5 |
| 3,920,496 | 11/1975 | Wilkinson et al. | 156/82 |
| 4,064,302 | 12/1977 | Kozlowski et al. | 428/152 |
| 4,114,797 | 9/1978 | Manizza | 229/188 X |
| 4,238,069 | 12/1980 | Morris, Jr. | 229/117.15 |
| 4,254,173 | 3/1981 | Peer, Jr. | 428/204 |
| 4,262,050 | 4/1981 | Jenkins | 428/138 |
| 4,343,533 | 8/1982 | Currin et al. | 350/288 |
| 4,432,820 | 2/1984 | Thompson | 156/82 |
| 4,455,184 | 6/1984 | Thompson | 156/244.11 |
| 4,496,417 | 1/1985 | Haake et al. | 156/361 |
| 4,544,597 | 10/1985 | Peer, Jr. et al. | 428/182 |
| 4,549,917 | 10/1985 | Jensen, Jr. | 156/108 |
| 4,572,752 | 2/1986 | Jensen et al. | 156/64 |
| 4,600,140 | 7/1986 | Milliens | 229/48 |
| 4,610,739 | 9/1986 | Jensen | 156/64 |
| 4,632,302 | 12/1986 | Manizza | 229/171 |
| 4,661,414 | 4/1987 | Kowaiski | 428/461 |
| 4,691,858 | 9/1987 | Peer, Jr. | 206/621.2 |
| 4,694,181 | 9/1987 | Piller | 250/548 |
| 4,704,171 | 11/1987 | Thompson et al. | 156/64 |
| 4,705,173 | 11/1987 | Forbes, Jr. | 206/563 |
| 4,757,937 | 7/1988 | Maio et al. | 229/41 |
| 4,765,855 | 8/1988 | Geoffroy-Dechaume et al. | 156/205 |
| 4,786,353 | 11/1988 | Templeton et al. | 156/359 |
| 4,832,257 | 5/1989 | Wood | 229/186 |
| 4,844,331 | 7/1989 | Oldfather | 229/178 |
| 5,458,270 | 10/1995 | Tsao | 229/188 X |
| 5,609,293 | 3/1997 | Wu et al. | 229/939 X |

FOREIGN PATENT DOCUMENTS

| | | | |
|---|---|---|---|
| 78 10471 | 11/1979 | France | B65D 65/40 |
| 726949 | 3/1955 | United Kingdom . | |

*Primary Examiner*—Gary E. Elkins
*Assistant Examiner*—Tri M. Mai
*Attorney, Agent, or Firm*—Deveau, Colton & Marquis

[57] ABSTRACT

A foldable laminated paperboard chest for transporting and storing food products, and a one-piece laminated paperboard blank from which such a chest is constructed. The chest includes a leak-proof corner construction and a plastic film coating layer to prevent leakage of fluid contents, an integral handle, and a locking closure top.

17 Claims, 5 Drawing Sheets

INSULATED CHEST

BACKGROUND OF THE INVENTION

1. Field of the Invention

The present invention relates generally to an insulated, foldable chest, and relates more specifically to a laminated paperboard or corrugated paperboard cooler for storing and transporting food and other products, which cooler is foldably constructed from a flat, die-cut blank to form a container having a leak-proof corner construction, a convenient carrying handle, and which eliminates the need for gluing in its assembly.

2. Description of Related Art

Folded paperboard and corrugated paperboard containers have been developed for a variety of uses, and have been found to provide an economical means for storing and transporting a variety of products. For example, disposable concession trays, such as those disclosed by U.S. Pat. No. 4,705,173 to Forbes, Jr., and U.S. Pat. No. 4,757,937 to Maio, et al., have been found to provide inexpensive and disposable coolers for transporting food and drink. These folded paperboard coolers are typically fabricated from a die-cut paperboard blank, which can be stored in a flat configuration, in order to minimize space requirements during shipping and prior to their use by the consumer. The paperboard blanks are typically configured in a manner which permits quick and easy assembly into their erected configurations when placed into use.

The structural configuration of many known folded paperboard or corrugated paperboard containers prevents them from being utilized in applications where fluid contents are introduced into the container and in situations where the contents must be maintained at higher or lower temperatures than the ambient conditions. In particular, the corner construction of many known foldable paperboard or corrugated paperboard containers incorporates slits or openings cut into the blank to facilitate forming corners when the blank is folded into its assembled configuration. Thus, if fluid contents are introduced into the assembled container, the contents will leak from the container through these slits or openings.

For example, U.S. Pat. No. 4,632,302 to Manizza shows a folded panel baking tray wherein the tray's corners comprise an open slot between upright side walls, resulting from the tray's assembly from a blank having a generally rectangular corner cutout. When the blank of the Manizza reference is foldably assembled to form its shallow tray, adjacent edges of the side wall panels at this corner cutout form a slotted corner which is incapable of retaining fluid contents. Moreover, the C-shaped or caddie cuts required along the base panel of the Manizza tray present further openings from which fluid contents can leak. It has also been recognized that containers such as that disclosed by the Manizza reference suffer the further disadvantage that gluing of certain panels is necessary to assemble the container. Such gluing results in additional time and expense to assemble the container, and is preferably avoided.

Another variety of foldably assembled cooler is disclosed by U.S. Pat. No. 4,844,331 to Oldfather. This container includes a corner assembly formed by a slit in its die blank which may permit any fluid content to leak. In addition, a slot is cut into the main panel of this assembly near its corner to receive a locking tab for retaining the structure in its assembled configuration. This slot, owing to its location adjacent the floor of the assembled container presents a further point of potential leakage of fluid contents.

U.S. Pat. No. 4,832,257 to Wood shows a paperboard tray having folded corners requiring no cut lines or openings. However, in order to retain this tray in its assembled configuration, it is necessary to adhesively secure the corner assemblies in their upright configuration. The necessity of gluing disadvantageously requires additional time and expense in the assembly of this tray. Also, because the corner assemblies must be glued to retain the tray in its upright configuration, the tray cannot readily be knocked down into a generally flat configuration for more easy access to the contents of the tray, without substantially damaging the tray. Thus, the tray disclosed by this reference is not suitable for applications in which it is desired to periodically disassemble and reassemble the tray. Moreover, the corner assemblies of this variety of tray are typically glued in the assembled configuration at their point of manufacture. Therefore, the blanks cannot be shipped to their point of use in a flat, unfolded configuration.

Because these folded containers are used for and transport a variety of products, it is desirable to provide one or more handles for facilitating carrying of the folded container. It has also been found desirable to provide closure means for sealing the container's contents from external contact or contamination. In order to permit convenient access to the container's contents, however, it is desirable to provide such closure means in a manner which will enable the container to be opened and closed, as desired, without damaging the container itself Patents are known disclosing enclosed cartons and handle assemblies. For example, see U.S. Pat. No. 4,838,479 to Wood. Known containers, however, do not disclose the insulation and leak proof properties of the present invention.

Therefore, it can be seen that a need exists for a foldable paperboard or corrugated paperboard container which enables the fluid contents to be contained therein. A need further exists for a thermally insulated foldable container which can maintain elevated interior temperatures for heated contents, and lower interior temperatures for cooler contents. A need also exists for such a container that is constructed without the use of glue, which may weaken or liquefy at elevated temperatures. A need further exists for such a container which can be easily erected by folding and be disassembled in the same manner. It is to the provision of such a chest, and a blank for foldably constructing such an insulated chest, that the present invention is primarily directed.

BRIEF SUMMARY OF THE INVENTION

Briefly described, in its preferred form, the present invention comprises a foldable container constructed of paperboard or corrugated paperboard having plastic films laminated to its interior and exterior. Unless otherwise indicated, the term "paperboard" used herein will also include corrugated paperboard, cardboard and other like foldable materials. The container is foldably constructed from a flat blank of this laminated paperboard to form a closed-top container (i.e. chest) which can be used for storing and carrying a variety of food and other products and maintaining those products at a range of temperatures. In its assembled state, the chest of the present invention provides a leak-proof enclosure for fluid contents. The present invention also comprises a laminated blank for fabricating such a chest.

The foldable laminated container of the present invention preferably comprises a leak-proof corner assembly wherein a tab foldably attached to the corner assembly is folded against the exterior of an end wall and engaged within a retaining slot in the top of the end wall. These corner assemblies maintain the lower portion of the container in its assembled configuration. Further, the container incorporates handle sections which do not interfere with the use of the container's interior space, and provide a convenient handle by which to grasp and carry the assembled container. In the preferred container's assembled configuration, retaining slots are located in the end flaps between the top of the end walls and inclined top sections of the container, where the retaining slots will not present an opening from which fluid contents could leak from the container when it rests upon its bottom.

In its assembled form, the container of the present invention preferably also comprises a hinged upper portion which can be opened to provide access to the container's contents, and closed to more securely maintain the contents, prevent exterior contamination of the contents, and thermally insulate the contents. In the open position, the hinged upper portion can be completely retracted away from the container's top opening to minimize any interference in accessing the container's contents. The container of the present invention preferably also comprises fastening means for securing the hinged upper portion in the closed position to prevent the unintentional opening of the container. In the preferred container the fastening means are retaining tabs located in the hinged upper portion for engaging the retaining slots in the end flaps.

The blank from which the container of the present invention is assembled preferably comprises a laminate of paperboard or corrugated paperboard and an inner and outer liner surface of insulating, leak-proof material. The preferred inner and outer liner material is a polyester film laminated to the paperboard material by a low-density polyethylene, which functions as an adhesive.

Accordingly, it is an object of the present invention to provide a folded laminated paperboard container which is insulated to maintain the temperature of enclosed contents.

It is another object of the present invention to provide a folded paperboard container which prevents the leakage of fluid contents such as water.

Still another object of the present invention is to provide a laminated paperboard blank which can be quickly and easily assembled into a container for storing and carrying food products or other contents, without the necessity of gluing or otherwise permanently attaching any components thereof.

Another object of the present invention is to provide a retaining tab/slot fastening mechanism which will not be damaged by assembly and disassembly of the blank, and where such fastening mechanism is very easy to operate.

Yet another object of the present invention is to provide a foldable laminated paperboard container having an upper portion, which is easily opened for convenient access to the contents thereof, without damaging the container, and which upper portion can be secured in its closed configuration.

Another object of the present invention is to provide an inexpensive, lightweight, sturdy and stable container for carrying and storing food products.

Yet another object of the present invention is to provide a foldable paperboard container having an upper portion and constructed of a waterproof insulating laminate material, which container can be fabricated by folding a flat blank into its assembled state, without the need for glue or other adhesives, and which can be disassembled and reassembled without causing damage to the blank.

Still another object of the present invention is to provide a container which the user can buy in an unitary blank form and assemble into a container for storing and carrying food products and other contents. Additionally, the user can disassemble the laminated container and store it in the blank form, where the assembly and disassembly do not cause damage to the blank.

These and other objects, features and advantages of the present invention will become more apparent upon reading the following specification in conjunction with the accompanying drawing figures.

DETAILED DESCRIPTION OF A PREFERRED EMBODIMENT

Figure 1:
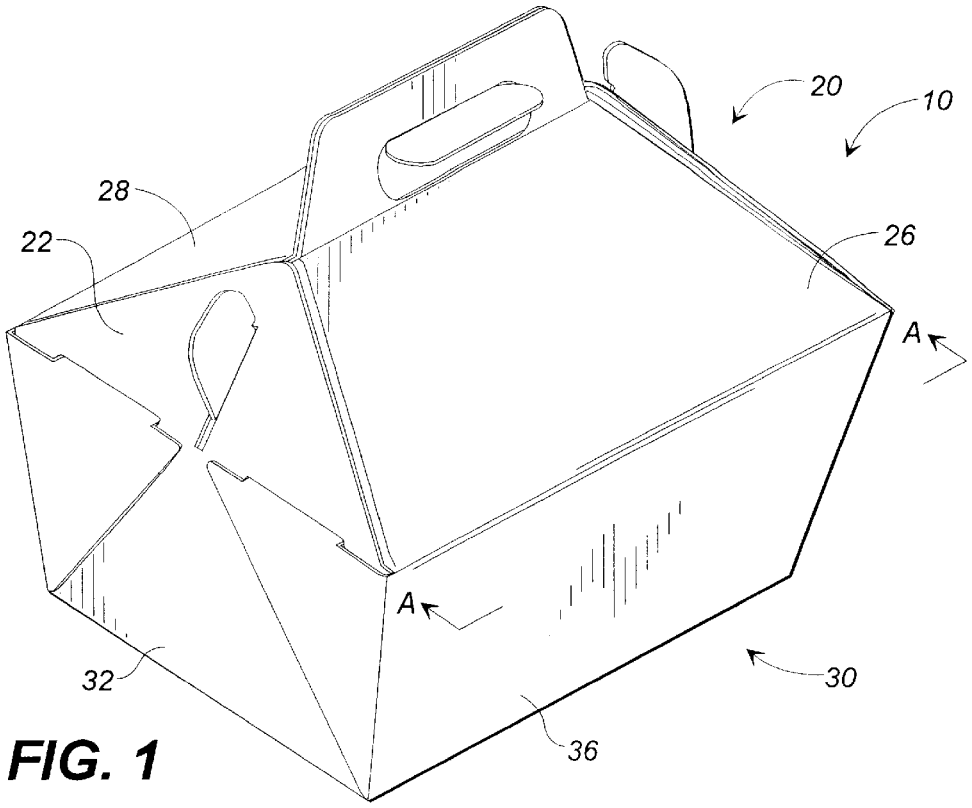
FIG. 1 is a perspective view of the foldable laminated paperboard container of the present invention, according to preferred form, in its assembled configuration.
Figure 2:
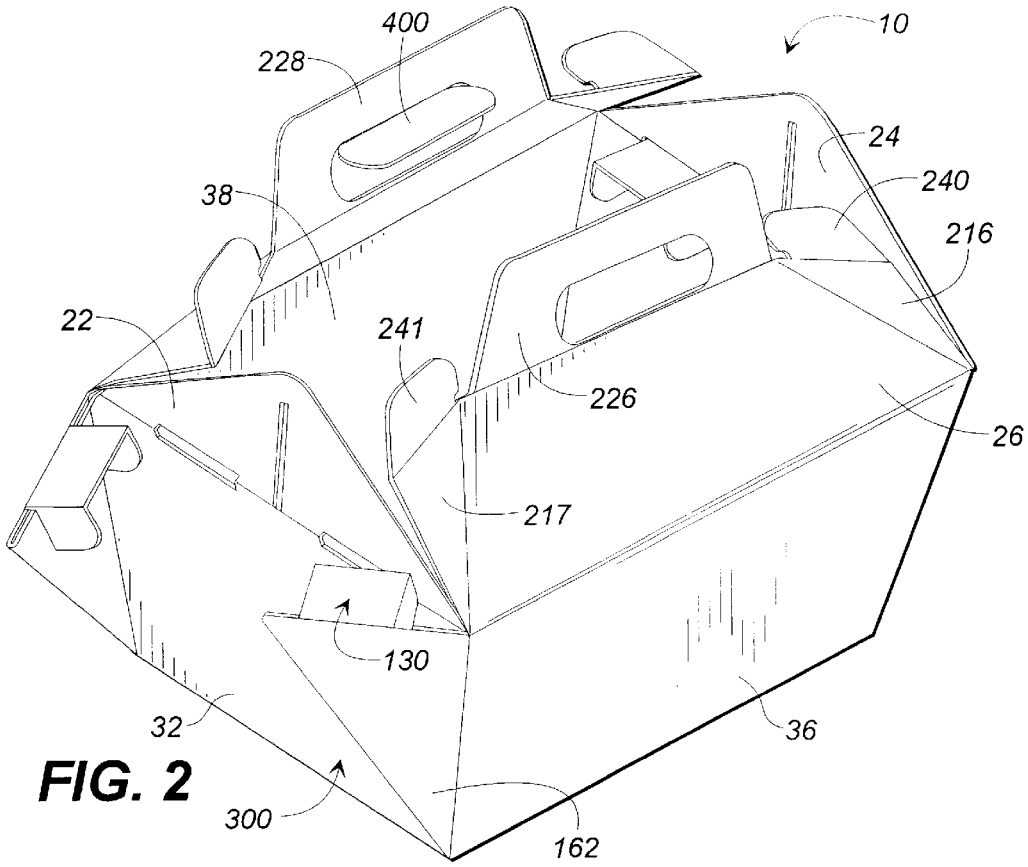
FIG. 2 is a perspective view of the foldable laminated paperboard container of FIG. 1, shown in a partially assembled configuration.
Figure 3:
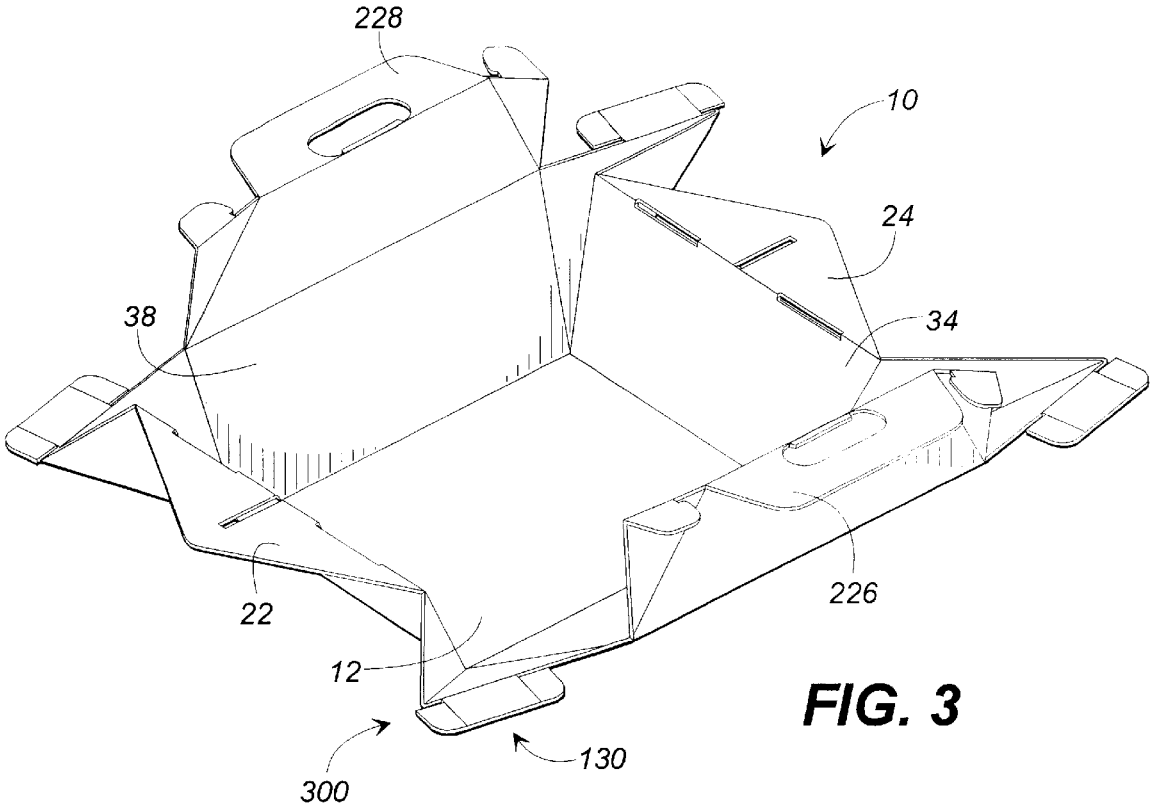
FIG. 3 is a second perspective view of the foldable laminated paperboard container of FIG. 1, shown in a partially assembled configuration.

Referring now in detail to the drawing figures, wherein like reference numerals represent like parts throughout the several views, FIGS. 1–3 show the insulated folded container 10 of the present invention, which generally comprises an upper portion 20 and a lower portion 30. It should be noted that the present invention is described throughout as either a chest, cooler, or container. As shown in FIG. 1, the upper portion 20 and the lower portion 30 of the container 10 are defined as the portions of the container 10 above and below and imaginary plane A—A, respectively. The upper portion 20 comprises first and second end flaps 22 and 24 and first and second top sections 26 and 28.

Figure 4:
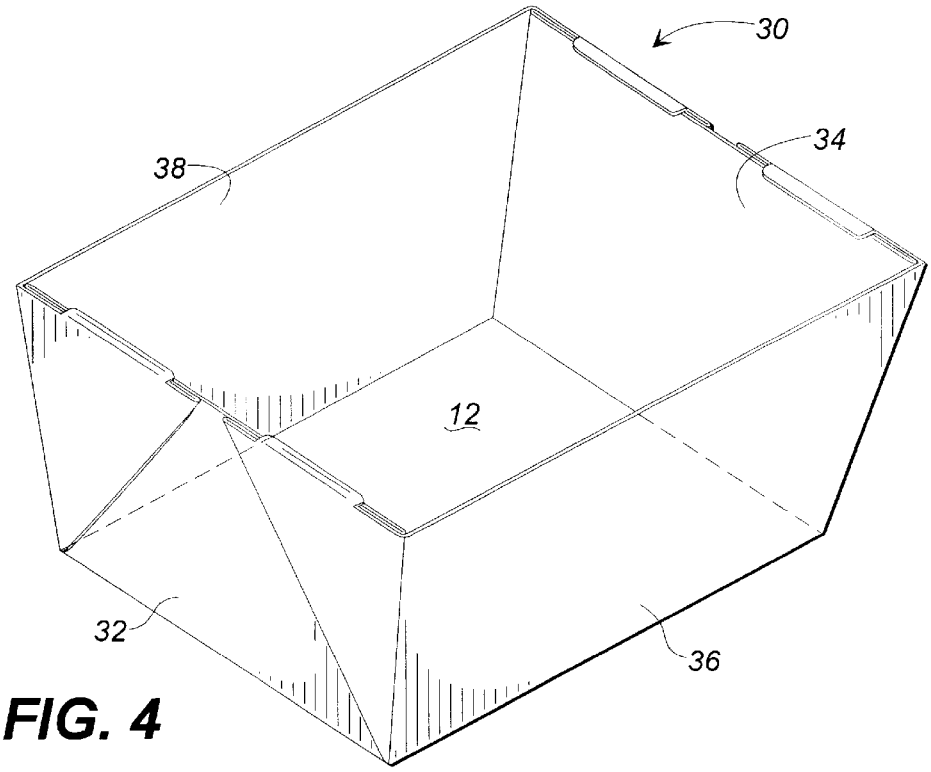
FIG. 4 is a cutaway perspective view of the bottom portion of the foldable laminated paperboard container of FIG. 1, as defined by cutting the container of FIG. 1 along the plane A—A.

FIG. 4 is a cutaway view of the container 10, with its upper portion 20 removed to better show the construction of the lower portion 30. The lower portion 30 generally comprises a bottom 12, first and second end walls 32 and 34, and first and second side walls 36 and 38.

As seen best in FIGS. 1–3, the upper portion 20 of the folded container 10 of the present invention can be opened and closed without disassembly of the lower portion 30. As shown, the first and second top sections 26, 28 are foldably connected to the first and second side walls 36, 38, respectively. This foldable connection forms a "hinge" joint which enables the first and second top sections 26, 28 to be opened to allow access to the interior of the container 10, or to be closed to protect and insulate the contents of the container 10. Fastening means can be provided for engaging a portion of the first and second top sections, and the first and second end flaps 22,24, therefore retaining the first and second top sections 26, 28 in their closed configuration, as will be described in greater detail below.

In preferred form, first and second top sections 26, 28, and first and second end flaps 22, 24 form a generally roof-shaped structure. Top sections 26, 28 incline from the tops of the respective side wall, to the point at which the top sections meet. First and second end flaps 22, 24 also incline and meet the top sections, to form the roof-shaped structure.

Figure 5:
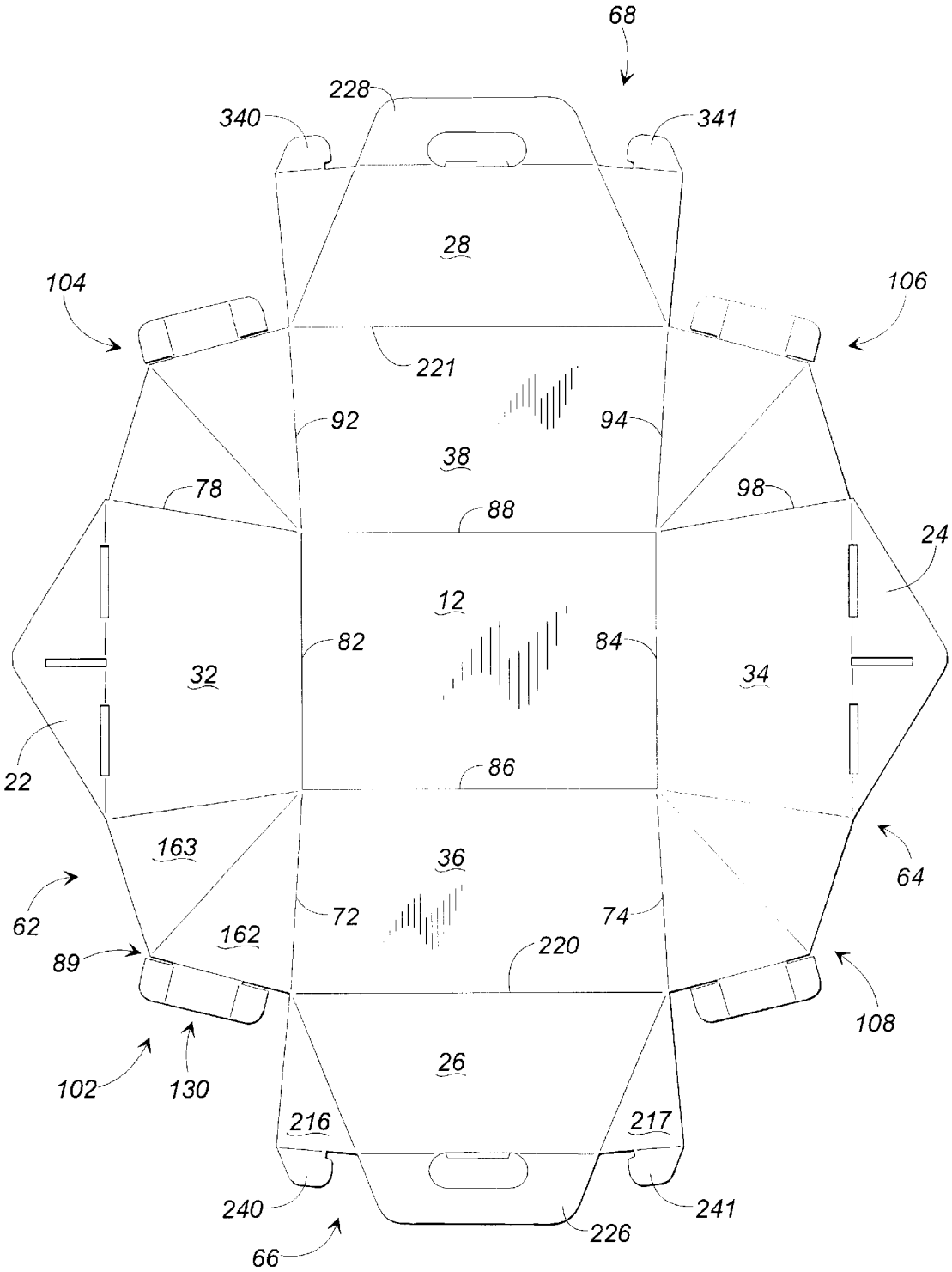
FIG. 5 is a plan view of a laminated paperboard blank according to a preferred form of the present invention.

The container 10 of the present invention is constructed by folding a one-piece blank 40, which is shown in the preferred form in FIG. 5. The blank 40 is die-cut and scored, according to known techniques, from a flat sheet of laminated material, which material will be described in greater detail below.

As shown in FIG. 5, assembly of the container 10 from the blank 40 will be more readily understood by defining the blank 40 to comprise five segments: the bottom 12, a first end section 62, second end section 64, a first side section 66 and a second side section 68.

The first end section the left of the following elements of the blank 40 of FIG. 5 to the left of the following three score lines: web score line 72, end score line 82, and web score line 92. The second end section 64 comprises those elements of the blank 40 to the right of web score line 74, end score line 84, and web score line 94. The first side section 66 comprises those elements below side score line 86. The second end section 68 comprises those elements above side score line 88.

The bottom 12 preferably is generally rectangular, and is bounded by end score lines 82 and 84, and side score lines 86 and 88.

The first and second end sections 62 and 64 are generally identical mirror images of one another, as are the first and second side sections 66 and 68. Therefore, for purposes of brevity, only the first end section 62 and the first side section 66 will be described in detail. It will be understood by those of ordinary skill in the art that the second end sections 64 and the second side section 68 are mirror images of and are of similar construction to those described.

Figure 6:
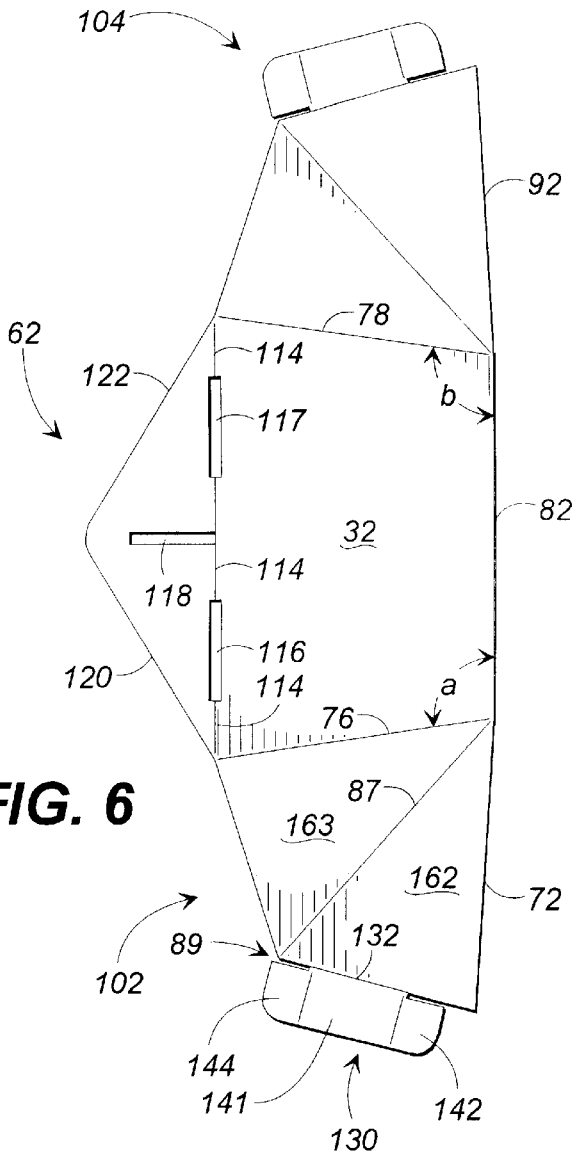
FIG. 6 shows in greater detail the left section of the blank of FIG. 5.

As shown in FIG. 6, the first end section 62 preferably comprises first end wall 32, first end flap 22, and corner webs 102 and 104. The first end wall 32 and the first end flap 22 are foldably connected to one another by means of score line 114.

The first end wall 32 has a shape as defined by the generally parallel folds lines, i.e. end score line 82 and score line 114, and by web score lines 76 and 78. Score line 114 runs the full length of one side of the first end wall 32, creating a line of folding that continues through retaining slots 116, 117, both of which lie on score line 114. The score line 114 is preferably longer than the end score line 82, and the web score lines 76 and 78 are generally equal in length and at an angle to end score line 82 of equal angles a and b. It will be understood that the angles a and b, in relation to score line 82, will define the shape of first end wall 32. As angles a and b move further beyond 90°, first end wall 32 deforms further from a generally rectangular shape. In one embodiment of the present invention, the score line 114 is approximately twenty percent (20%) longer than the end score line 82, and approximately sixty percent (60%) longer than web score lines 76 and 78.

The first end section 62 further comprises first end flap 22. End flap 22 preferably is generally shaped as an isosceles triangle with its base comprising the score line 114, and having two equal length side edges 120 and 122. The score line 114 foldably connects the first end wall 32 to the first end flap 22. In one preferred embodiment, the length of the score line 114 is approximately thirty-five percent (35%) longer than the height of the flap 22, defined as the length of the bisect of score line 114 to the junction of edges 120 and 122.

The first end section 62 has corner webs 102 and 104, adjacent to a corner of the bottom 12 between adjacent end and side walls. As shown in FIG. 5, the first and second end sections of the blank 40 each have two corner webs. Therefore, the blank 40 has four corner webs. Each corner web is generally identical in construction and, therefore, only a single corner web 102 will be described in detail.

The corner web 102 is located between the web score lines 72 and 76, as shown in FIGS. 5 and 6. The corner web 102 foldably connects to the first end wall 32 at the web score line 76, and to first side wall 36 at web score line 72. A diagonal score line 87 preferably extends generally centrally along the corner web 102, between the adjoining corner of the bottom 12 and outer corner 89 of the corner web 102. The diagonal score line 87 divides the corner web 102 into two generally equal triangular panels, 162 and 163.

Figure 8:
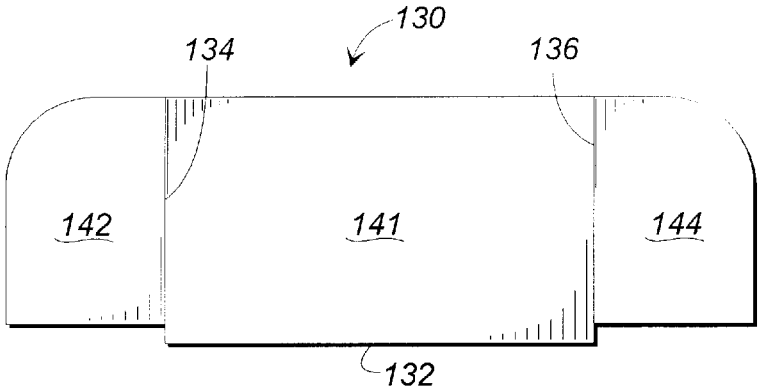
FIG. 8 shows in greater detail a generally rectangular tab portion of the left section of the blank of FIG. 6.

The corner web 102 preferably further comprises a generally rectangular tab 130 which is hingedly connected to the triangular panel 162 by a score line 132. As seen best in FIGS. 6 and 8, the tab 130 also has score lines 134 and 136, both generally perpendicular to the score line 132. The score lines 134 and 136 define end tabs 142, 144 and middle tab 141. The score line 132 runs the entire length of the middle tab 141. In one preferred embodiment, the end tabs 142 and 144 are raised above the score line 132 approximately the thickness of the blank 40 and are detached from the triangular panel 162 to permit the end tabs 142, 144 to be folded relative to the middle tab 141. Preferably, the end tabs 142 and 144 are generally identical, and their lengths are generally less than one-half the length of the middle tab 141.

Figure 7:
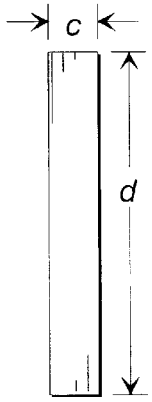
FIG. 7 shows in greater detail a retaining slot of the left section of the blank of FIG. 6.

As seen best in FIGS. 6 and 7, the first end section 62 preferably further comprises retaining slots 116, 117 and 118. The retaining slots 116, 117 and 118 are generally rectangular in shape. The slots 116 and 117 preferably have a height c and a length d as shown in FIG. 7. Height c is preferably slightly greater than twice the thickness of the laminated paperboard comprising the blank 40. Length d is preferably slightly greater than the length of score line 132 of middle tab 141. The slots 116 and 117 are located generally midway between the respective ends of the score line 114 and its midpoint. The slots 116 and 117 preferably lie along the score line 114. The slot 118 preferably is generally perpendicular to score line 114, extending from the approximate midpoint of the score line 114.

Figure 9:
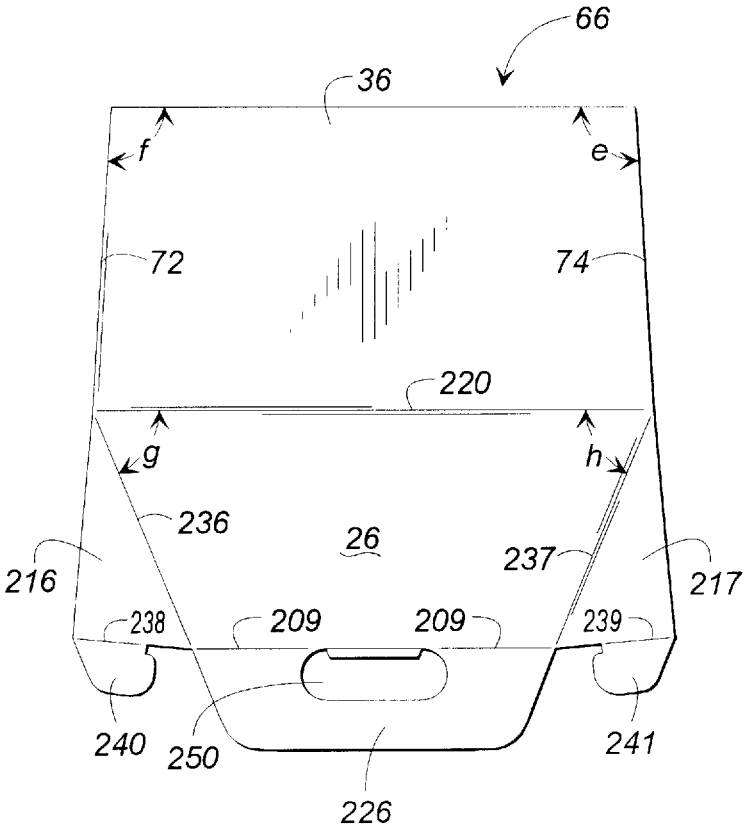
FIG. 9 shows in greater detail the bottom section of the blank of FIG. 5.

As shown in FIG. 9, the first side section 66 preferably comprises the first side wall 36, the first top section 26, and a first handle portion 226. The first side wall 36 and the first top section 26 are foldably connected to one another by means of score line 220.

The first side wall 36 is bounded by the two generally parallel score lines 86 and 220, and the web score lines 72 and 74. The score line 220 preferably is slightly longer than the score line 86, and the web score lines 72 and 74 are preferably generally equal in length, at equal angles e and f to score line 86. It will be understood that the angles e and f, in relation to score line 86, will define the shape of the first side wall 36. As angles e and f move further beyond 90°, first side wall 36 deforms further from a generally rectangular shape. In one preferred embodiment of the present invention, the score line 220 is approximately fifteen percent (15%) longer than the end score line 86 and approximately eighty-five percent (85%) longer than the web score lines 72 and 74.

The first side section 66 further comprise first top section 26. The first top section 26 has a shape as defined by the two generally parallel score lines 209 and 220, and the score lines 236 and 237. The score line 220 preferably is longer than the score line 209, and the score lines 236 and 237 are preferably generally equal in length. The angles g and h, in relation to score line 220, define the shape of the first top section 26. In one preferred embodiment of the present invention, the score line 220 is approximately fifty percent (50%) longer than the score line 209 and approximately twice as long as the score lines 236 and 237.

Figure 10:
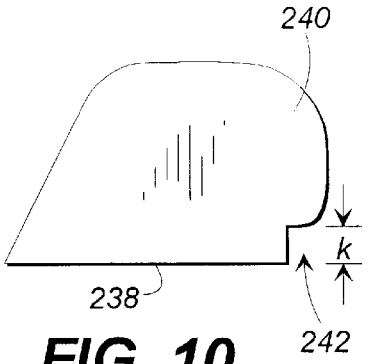
FIG. 10 is a detailed view of a tab of the bottom section of the blank of FIG. 9.

The first side section 66 may further comprise first and second securing flaps 216 and 217, foldably connected to opposite ends of the first top section 26 along score lines 236 and 237, respectively. Tabs 240 and 241 are preferably generally identical to one another and are hingedly connected to the securing flaps 216, 217, respectively, along score lines 238, 239. As shown best in FIG. 10, the tab 240 has a notch 242. The height k of notch 242 is preferably slightly greater than the thickness of the laminated paperboard comprising the blank 40 to facilitate ease in assembly and opening.

The first top section 26 foldably connects to the first handle portion 226 along the score line 209. The first handle portion 226 has a cut-out 250, preferably in the general shape of an oblong oval. The cut-out 250 is designed to accommodate a person's fingers for easy carrying of the container 10. In assembled form, the container 10 comprises a carrying handle formed by the first handle portion 226 of the first side section 66 and the second side handle portion 228 of the second side section 68. In order to keep the two portions of the handle in proximity when the container 10 is assembled and in its "closed" configuration, the first handle portion 226 of the side section 66 can retain that portion of the blank 40 cut to form cut-out 250 by leaving one side of the cut-out intact to form a flap 400, as shown in FIG. 2. The flap 400 foldably attaches to the score line 260, and can be folded through the cut-out 250 of the first handle portion 226 to retain the handle portions in proximity.

Construction of the Container

The blank 40, shown best by FIG. 5, can be fabricated from a laminate material comprising plastic films bonded to a paperboard or corrugated paperboard substrate. The plastic films may incorporate moisture/vapor barrier, reflective, and thermal insulative characteristics. In the preferred embodiment, the paperboard substrate is an E-fluted corrugated paperboard, but other materials may be substituted, for example, A-, B-, C-, D-, or F-fluted, or micro-corrugated paperboard, or other foldable materials. The flutes add to the insulative properties of the paperboard. In one embodiment, the surfaces of the blank 40 that will eventually become the inner and outer surfaces of the assembled container 10, have a plastic film laminated to the paperboard substrate. The film may be a bioriented polyester. The biorientation of the plastic film imparts stability to the paperboard.

Preferably, the eventual inner and outer surfaces are provided with a reflective coating for improved thermal insulation and appearance. For example, aluminum and gold may be used as a reflective coating metals as can other metals. In the preferred embodiment, the plastic film is bonded to the paperboard by a low-density polyethylene. The bonding agent used to bond the plastic films to the substrate may also comprise other blends of polyethylene, including a small amount of high-density polyethylene. The reflective coating metals are preferably included in the bonding agent. The layered nature of the laminate blank material provides improved insulative characteristics.

Lamination of the substrate can be completed before or after fluting, but lamination should be completed before scoring and cutting the blank 40.

The blank 40, as described above, can be foldably constructed to form the container 10 as will now be described in greater detail. FIGS. 2 and 3 show the container 10 in a partially assembled configuration. The first and second end sections 62, 64 and the first and second side sections 66, 68 are first folded upwards relative to the bottom 12, along the score lines 82, 84, 86 and 88, into a position generally perpendicular to the bottom 12. In the preferred form, when the first and second end walls 32, 34 and the first and second side walls 36, 38 are in their assembled positions, the walls will lie in planes slightly outward from perpendicular planes to the bottom 12, forming sloped walls whereby the top opening of the lower portion 30 of the container is somewhat larger than the bottom 12 to facilitate access to the interior of the container. See FIGS. 1–4.

The corner webs are folded outwardly relative to the first and second end walls 32, 34 and the first and second side walls 36, 38. The corner webs 102, 104, 106, 108 are preferably generally identical, and will be described using corner web 102 as an example. Corner web 102 is folded outwardly along the diagonal score line 87, so that the corner web 102 forms a flap 300 extending outwardly from the edge where the score lines 72 and 76 meet, as best seen in FIGS. 2 and 3. The flap 300 generally comprises the triangular panels 162, 163, and having the tab 130 extending upward from the score line 132 of the triangular panel 162. As the flap 300 comprises the corner web 102 folded upon itself at the diagonal score line 87, the flap 300 has a total thickness of twice the thickness of the laminated paperboard comprising the blank 40. The tab 130 has a total thickness equal to that of a single layer of the laminated paperboard, in that the tab 130 lies only on the triangular panel 162 of the corner web 102.

The tab 130 is next folded inwardly and downwardly towards the first end wall 32, to a position generally perpendicular to the flap 300 at the score line 132, so that the tab 130 will fold over both top edges of the triangular panels 162 and 163. Next, the end tabs 142 and 144 are folded downwardly along the score lines 134 and 136 as is shown in FIGS. 2 and 3, and are then further folded and tucked under the middle tab 141 of the tab 130, so that the tab 130 generally forms a member with a length of the middle tab 141 and a thickness of approximately twice the thickness of the laminated paperboard comprising of the blank 40. The length of the tab 130 with the tabs 142 and 144 tucked underneath is just slightly less than the length d of the slit 116 to retain the flap 300 in secure position to the first end wall 32.

The flap 300 is next folded in proximity to the exterior surface of the first end wall 32, as shown by FIGS. 2 and 3. As the flap 300 is folded against the end wall 32, the folded tab 130 is inserted through the slot 116 until the tab 130 passes through the slot 116, into the container's interior. End tabs 142, 144 are released or, if necessary, folded back to a position generally perpendicular to the middle tab 141 of the tab 130, so that end tabs 142, 144 act to retain the tab 130 within the slot 116 and, thereby, to retain the flap 300 against the end wall 32 and to retain the container's walls upright. End tabs 142, 144 could alternatively further be folded to a position generally parallel to the middle tab 141 of the tab 130 to attain the same fastening result. At this point, the tab 130 is releasably locked in place. These steps are repeated to secure the corner webs 104, 106 and 108 into like positions.

The lower portion 30 of the container 10 is now rigidly fixed in a generally box-like configuration, whereas the upper section 20 can still freely fold about the various upper section 20 score lines. A topless container can be formed only of those elements as described above, comprising only the lower portion 30. A blank incorporating this embodiment can be easily designed by modifying the blank 40.

Materials can be stored in the container's lower portion, and the upper portion opened and closed to access the materials without any disassembly of the lower portion. Should it be necessary to disassembly the lower portion, however, such disassembly can be accomplished without damaging the blank 40, simply by retracting the tabs from the slots. To facilitate retracting the tab 130 from the slot 116, the end tabs 142 and 144 are again tucked under the middle tab 141 of the tab 130, and the tab 130 is slid outward through the slot 116.

To close the top of the container 10, the first and second top sections 26, 28 are folded downwardly towards the container's interior about the score lines 220, 221, respectively until the inner surface of the first handle portion 226 comes in contact with the inner surface of the second handle portion 228. At this point, the respective cut-out portions of the handles will be aligned. While the first and second top sections 26 and 28 are folded toward each other, their respective handle portions will also fold about their respective score lines. For example, the first handle portion 226 will fold about the score line 209 so that the interior surface of the first handle portion 226 will lie flush against the interior surface of the corresponding second handle portion 228 of the second top section 28. At this point, the tabs 240, 241 will align with the corresponding tabs 340, 341 of the second top section 28 so that the interior surface of the tabs are flush and lie in the same plane as the handle portions. The flap 400 of the second handle portion 228 is folded about the score line 260, so that the flap 400 foldably rotates through cut-out 250 of the first handle portion 226.

Finally, the first end flap 22 is folded about the score line 114 until the tab 240 and tab 340 from the second top section 28 slip into and through the slot 118 until the top portion of the slot 118 slides into and rests within notch 242 of the tab 240, thereby retaining the tab within the slot and fastening the upper portion 20 of the container 10 in its closed position. It is understood that the same procedure follows for the second end flap 24.

In its assembled form, the present invention does not present any openings in the lower portion from which fluid contents could leak, since the corner webs 102, 104, 106 and 108 continuously connect the adjacent end and side walls, whereby only the score lines and not cuts or openings, are required to form the corners. The slots are located at the top of the end walls, therefore creating a leak-proof lower portion 30.

In use, the above described blank 40 can be assembled to form the container 10 as described, according to the above described assembly method. The container 10 can then be used for storing and carrying food and other products for a variety of applications. In preferred form, the container 10 can function as a chest for containing, for example, soda or beer, which can be maintained at a refrigerated temperature due to the insulating nature of the materials of the chest. Similarly, heated contents can be kept hot in the container 10 of the present invention, owing to its insulative qualities, by enclosing hot products within the chest, or by placing a "hot-pack" or other similar device into the chest before adding the products to be kept heated. Because container 10 can function as a chest, ice used to maintain cool temperatures in the container would not leak out of the chest when it eventually melts into ice water.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A container foldably assembled from a flat blank, said container comprising:

(a) a bottom with sides and ends;

(b) first and second end walls extending generally upward from, and hingedly connected to, opposite ends of said bottom;

(c) first and second side walls extending generally upward from, and hingedly connected to, opposite sides of said bottom;

(d) a corner portion forming a continuous web between, and hingedly connected to, each adjacent side wall aid end wall, wherein a diagonal score line extends generally centrally along each said corner portion, dividing said corner portion into two generally equal triangular panels, with one panel adjacent the side wall;

(e) a tab extending from, and hingedly connected to, the top edge of each said corner portion wherein said tab is foldably connected to the triangular panel adjacent the side wall, said tab having foldable end tabs and middle tab; and (f) generally rectangular slots provided in proximity to the top edge of each said first and second end wall, each slot having a width that is slightly grater than the thickness of said blank, and having a length slightly greater than the length of said middle tab;

(g) fastening means for releasably fastening said container into a generally rigid, box-like configuration, wherein said fastening means comprises an arrangement of said tabs and slots wherein the tab can be inserted through, and releasably retained within, the slot (h) first and second end flaps foldably connected to the top edge of each said first and second end wall, respectively;

(i) first and second top sections foldably connected to the top edge of each said first and second end wall, respectively;

(j) securing flaps foldably connected to the opposite ends of each said first and second top section;

(k) flap tabs foldably connected to the top edge of each said securing flap;

(l) a slot located in each said end flap generally perpendicular to the line of folding between each said end flap and said end wall, wherein said slot is generally rectangular, having a width that is slightly greater than twice the thickness of said blank, and having a length slightly greater than the length of said flap tabs; and (m) first and second handle portions foldably connected to the top edge of each said first and second top section, respectively.

2. The container of claim 1, wherein said container is fabricated from a laminated material comprising a plastic film bonded to a corrugated paperboard substrate.

3. The container of claim 1, wherein said container is fabricated from corrugated paperboard, and wherein the inner surfaces of said container are coated with a plastic film.

4. The container of claim 3, wherein said plastic film is bonded to said inner surfaces of said container by a bonding agent, wherein said bonding agent is a low density polyethylene.

5. The container of claim 4, wherein said plastic film is bonded to the outer surfaces of said container by sail bonding agent.

6. The container of claim 5, wherein said plastic film is a polyester.

7. The container of claim 6, wherein said bonding agent is a mixture of low density polyethylene and a small amount of high density polyethylene.

8. The container of claim 7, wherein said bonding agent further comprises a metallized reflective coating.

9. A unitary blank for foldably constructing a container, said blank comprising:

(a) a bottom with sides and ends;

(b) first and second end walls foldably connected to opposite ends of said bottom;

(c) first and second side walls foldably connected to opposite sides of said bottom;

(d) a corner portion forming a continuous web between, and foldably connected to, each adjacent side wall and end wall, wherein a diagonal score line extends generally centrally along each said corner portion, dividing said corner portion into two generally equal triangular panels, with one each adjacent the side wall;

(e) slots provided in proximity to the top edge of each said first and second end wall wherein said slots are generally rectangular, having a width that is slightly greater than twice the thickness of the said blank, and having a length slightly greater than the length of said middle tab; and (f) a tab foldably connected to the top edge of each said corner portion, wherein said tab foldably connected to the triangular panel adjacent the side wall with said tab having foldable end tabs and a middle tab;

(g) first and second end flaps foldably connected to the top of each said first and second end wall, respectively;

(h) first and second top sections foldably connected to the top edge of each said first and second side wall, respectively;

(i) securing flaps foldably connected to the opposite ends of each said first and second top section;

(j) flap, tabs foldably connected to the top edge of each said securing flap;

(k) a slot provided in each said end flap generally perpendicular to the line of folding between each said end flap and said end wall, wherein said slot is generally rectangular, having a width that is slightly greater than twice the thickness of said blank, and having a length slightly greater than the length of said flap tabs; and (l) first and second handle portions foldably connected to the top edge of each said first and second top section, respectively.

10. The blank of claim 9, wherein said blank is die-cut from a generally flat sheet of material, and wherein said blank has two faces, a first face of the blank which, upon assembly of the container, will become the inner surfaces of said container, and a second face of the blank which, upon assembly of the container, will become the outer surfaces of said container.

11. The blank of claim 10, wherein said blank is fabricated from corrugated paperboard, and wherein said first face of said blank is coated with a plastic film.

12. The blank of claim 11, wherein said plastic film is bonded to said first face of the blank by a bonding agent, wherein said bonding agent is a low density polyethylene.

13. The blank of claim 12, wherein said plastic film is bonded to the second face of said blank by said bonding agent.

14. The blank of claim 13, wherein said plastic film is a polyester.

15. The blank of claim 14, wherein said bonding agent is a mixture of low density polyethylene and a small amount of high density polyethylene.

16. The blank of claim 15, wherein said bonding agent further comprises a metalized reflective coating.

17. A method of fabricating a cooler from a unitary blank, wherein said blank comprises a bottom with sides and ends; first and second end walls foldably connected to the opposite ends of said bottom; first and second side walls foldably connected to the opposite sides of said bottom; a corner portion forming a continuous web between each adjacent side wall and end wall, wherein a diagonal score line extends generally centrally along each said corner portion, dividing said corner portion into two generally equal triangular panels, with one panel adjacent the side wall; a tab extending from the top edge of each said corner portion, wherein each said tab is foldably connected to the triangular panel adjacent the side wall, and wherein said tab comprises foldable end tabs and a middle tab; slots provided in proximity to the top edge of each said first and second end wall, wherein said slots are generally rectangular, having a width that is slightly greater than twice the thickness of said blank, and having a length slightly greater than the length of said middle tab; first and second end flaps foldably connected to the top edge of each said first and second end wall, respectively; first and second top sections foldably connected to the top edge of each said first and second side wall, respectively; securing flaps foldably connected to the opposite ends of said first and second top sections; flap tabs foldably connected to the top edge of each said securing flap; a slot provided in each said end flap generally perpendicular to the line of folding between each said end flap and said end wall, wherein said slot is generally rectangular, having a width that is slightly greater than twice the thickness of said blank, and having a length slightly greater than the length of said flap tabs; and first and second handle portions foldably connected to the top edge of each said first and second top section, respectively, said method comprising:

(a) folding said side and end walls upwards relative to said bottom into a position generally perpendicular to said bottom, whereby said corner portions form a flap;

(b) folding said flaps formed by said corner portions against said first and second end walls;

(c) engaging said corner portion tabs within said slots provided in proximity to the top edge of each said first and second end wall;

(d) closing said first and second top sections until the inner surfaces of both said handle portions and flap tabs in proximity to said end flap, are adjacent one another; and (e) engaging said flap tab within said slot provided in each said end flap.

* * * * *